US009464383B2

(12) United States Patent
Smith

(10) Patent No.: US 9,464,383 B2
(45) Date of Patent: Oct. 11, 2016

(54) DEACIDIFICATION TREATMENT OF PRINTED CELLULOSIC MATERIALS

(71) Applicant: Richard Daniel Smith, Park Forest, IL (US)

(72) Inventor: Richard Daniel Smith, Park Forest, IL (US)

( * ) Notice: Subject to any disclaimer, the term of this patent is extended or adjusted under 35 U.S.C. 154(b) by 201 days.

(21) Appl. No.: 13/839,898

(22) Filed: Mar. 15, 2013

(65) Prior Publication Data

US 2013/0302524 A1 Nov. 14, 2013

Related U.S. Application Data

(60) Provisional application No. 61/688,236, filed on May 10, 2012.

(51) Int. Cl.
*D21H 19/10* (2006.01)
*D21H 25/18* (2006.01)

(52) U.S. Cl.
CPC ..... *D21H 19/10* (2013.01); *D21H 25/18* (2013.01)

(58) Field of Classification Search
CPC ..... D21H 19/10; D21H 25/18
See application file for complete search history.

(56) References Cited

U.S. PATENT DOCUMENTS

| | | | | |
|---|---|---|---|---|
| 3,676,055 | A | 7/1972 | Smith | |
| 3,676,182 | A * | 7/1972 | Smith | 427/316 |
| 5,277,842 | A | 1/1994 | Wittekind et al. | |
| 5,322,558 | A * | 6/1994 | Wittekind et al. | 106/287.24 |
| 5,433,827 | A | 7/1995 | Page et al. | |
| 6,676,856 | B1 * | 1/2004 | Smith | 252/387 |

FOREIGN PATENT DOCUMENTS

CA 911110 A 10/1972

OTHER PUBLICATIONS

Michael Ramin et al., Paper De-acidification a Comparative Study, Journal of Paper Conservation, vol. 10, No. 3, 2009, pp. 17-25.

* cited by examiner

*Primary Examiner* — Peter F Godenschwager
*Assistant Examiner* — Andrew J Oyer
(74) *Attorney, Agent, or Firm* — Fitch, Even, Tabin & Flannery, LLP

(57) ABSTRACT

A deacidification composition for use in for treating printed cellulosic materials is provided. A method of making the composition and a method of preparing components of the composition also are provided. The composition includes a single metal alkoxide and a double metal alkoxide.

17 Claims, 7 Drawing Sheets

Acidic Books Receipt & Preparation for Treatment

Preparation & Recycling of Deacidifying & Biostatic Solution

Mass Deacidifying & Biostatic Treatment

Environmentally Responsible Disposal of Treatment Byproducts

DEACIDIFICATION TREATMENT OF PRINTED CELLULOSIC MATERIALS

CROSS-REFERENCE TO RELATED APPLICATIONS

This application claims the benefit of Provisional Application Ser. No. 61/688,236, filed May 10, 2012, which is incorporated by reference herein.

FIELD

The present application relates generally to compositions and methods for deacidification treatment and preservation of printed cellulosic materials, such as books, manuscripts and other image and information bearing documents and publications and works of art on paper, which may deteriorate or which may have become deteriorated through aging.

BACKGROUND

During the past 150 years, archives and libraries have struggled to prevent the aging of paper, i.e., yellowing and embrittlement of paper in documents and books. Many treatments to avoid or stop this aging have been proposed. The primary goals of these treatments are to either transform the paper into another, more stable medium or stabilize the paper against aging by deacidification. Deacidification has advantages in its effectiveness for many more years, availability of stabilized materials for use, and lower unit treatment costs.

Although previously known treatments reduce the rate that books and documents are aging, all known methods have the potential to deface or otherwise so harm significant portions of the collection so that the items are rendered unsatisfactory for ordinary use. Furthermore, numerous problems and environmental concerns exist with current treatment methods.

Moisture variation in anhydrous raw materials presents a significant problem when using most known treatment methods. As the quantity of moisture increases, either powder or gel precipitates will be formed, depending on time, reactivity, temperature and pressure conditions. These precipitates may prevent (poison), impede (slow) a manufacture or reaction rate and detrimentally affect the deacidification workability of solutions (clog spray nozzle assemblies, precipitate on paper surfaces and clog paper substrates). The precipitates also may deposit on and deface books and documents and block or clog filters, pipes, valves and other restricted passages in processing equipment. They may also deposit thick coatings on walls of tanks and, depending on relative densities, separate into top or bottom phase composition layers or even, in extreme cases, actually turn the treating solution (initially thinner than water) into an immobile gelatin-like gel.

Although produced, ultra-low moisture alcohol and aliphatic hydrocarbon and other solvents are not available commercially in standard containers, e.g., in 5-gallon pails or 55-gallon drums. Industrial solvent manufacturers do not deliver their solvents in an ultra-dry condition, i.e., below 15 or 25 ppm. For example, the maximum moisture content specification for a 55-gallon drum of research grade "anhydrous" methanol from Fisher Scientific is 1,000 ppm.

Sub-micron (less than 0.2 microns) coal black particles are known to precipitate in concentrates prepared for current treatment methods. The particles may be introduced as trace heavy metal (iron, cobalt, copper, etc.) impurities in the metals reacted with alcohols to produce alkoxide powders for use in treatment or by external conditions. These particles contaminate and discolor the treatment concentrate and must be removed before use in paper preservation. Additionally, allowing the particles to agglomerate naturally then filtering through a 0.2 micron absolute membrane filter limits the concentration of treatment concentrates that can be manufactured. For example, concentrations of organic magnesium of up to only 25 percent by weight in methanol are a maximum.

The more alkaline pH values produced by organic magnesium carbonate treatments may cause undesirable color changes. These treatments may cause sensitive inks, pigments, and dyes to change color when the cellulosic material is changed from a deteriorating acidic condition to a stable alkaline condition.

The traditional chlorofluoro carbon (CFC) and hydrochlorofluorocarbon (HCFC) solvent systems for organic metal carbonate deacidification compositions tend to deface or damage some types of inks and or cause structural book components to dissolve or soften. The more sensitive inks soften, bleed, strike through, offset, and in some cases, even glue the leaves of pamphlets and books together into solid blocks. In addition, the use of chlorofluorocarbon solvents are detrimental to the ozone layer and generally are prohibited by environmental regulations. Therefore, the use of such solvents should include recovery of the solvent to minimize release into the atmosphere.

Despite extensive efforts and the many solutions proposed for stopping aging, a truly satisfactory method that extends the useful life of cellulosic materials for hundreds of years has not been developed. No effective treatment is known that is acceptable and affordable for essentially all paper, inks, pigments, media, or other components of printed materials and is not hazardous to users.

Accordingly, there is a need to provide improved deacidification compositions and methods for making them, for preserving printed and written cellulosic materials, such as books, drawings, maps, works of art, manuscripts and images.

Additionally, there is a need to provide a method for universally preserving these cellulosic materials bearing printing, writing, drawings, or other recordings, with little or no impairment of inks, images, bindings or other visual or structural features.

SUMMARY

The compositions and methods described herein provide a one-time comprehensive paper treatment that fully protects paper and books against normal deterioration and/or wearing out. Heretofore, that objective or possibility was neither realistic nor possible. The deacidification compositions described herein are effective for treating and preserving printed cellulosic materials. Also described herein are methods treating and preserving printed cellulosic materials and methods of making the deacidification compositions including preparing components of these compositions.

These compositions and methods provide new and unexpected results as compared to previous processes, such as those described in U.S. Pat. No. 6,676,856 to Smith and U.S. Pat. No. 5,322,558 to Wittekind et al. which use similar alkoxides, but in separate processes. These unexpected results include extraordinarily fast preservation treatment times by the compositions described herein which will not precipitate or deposit on paper surfaces at least to the extent the deposits can not be seen by the naked human eye with 20/20 vision under ambient lighting conditions. Indeed the compositions and methods described herein deacidify the cellulosic material or paper without requiring large amounts of time for removal of solvent reactants and permits deacidification without requiring exposure of the process to controlled high relative humidity.

In an important aspect, the deacidification composition comprises a single metal alkoxide and a double metal alkoxide in an ultra-dry solvent blend having a moisture content of less than about 100 ppm where the solvent blend includes at least one of a first solvent selected from the group consisting of aliphatic hydrocarbon, hydrofluorocarbon, hydrochlorofluoro carbon and a second solvent selected from the group consisting of hydrocarbon, hydrofluorocarbon, hydrochlorofluorocarbon and mixtures thereof. The first and second solvents may be the same or a blend, but have less than about 100 ppm water. In one aspect, the deacidification composition may be made from two components and would be a part of a two component composition which is a solution. In this aspect the component composition is a solution which deacidifies a printed cellulosic material comprises a first component which includes a single metal alkoxide, alcohol and first component solvent. The first component has from about 0.1 to about 4 wt. %, based upon the weight of first component, of at least one of a single metal alkoxy and/or alkoxy carbonate, such as an alkoxy magnesium carbonate, an alkoxy aluminum carbonate and an alkoxy zinc carbonate; from about 0.025 to about 10 wt. % based upon the weight of the first component of a C1-C4 alcohol having a moisture content of less than 100 ppm; and from about 86 to about 99 wt. % based upon the weight of the first component of a solvent having a moisture content of less than 100 ppm, the solvent selected from the group consisting of an aliphatic hydrocarbon, a hydrofluorocarbon, a hydrochlorofluoro carbon and mixtures thereof. The second component of the deacidification solution comprises a solution of a double metal alkoxide and a second component solvent of a double metal alkoxide. The double metal alkoxide comprises at least about 0.20 weight percent, based upon the weight of the solution of the double metal alkoxide, preferably from about 0.20 to about 8 weight percent of the solution. The double metal alkoxide comprises a first and a second metal alkoxide associated with each other. In one form, the first metal alkoxide includes a first metal which promotes solubility and is selected from the group consisting of titanium and zirconium and the second metal alkoxide includes a second metal effective for binding acids in the paper. The second metal of the second metal alkoxide selected from the group consisting of magnesium and calcium. The double metal alkoxide is dissolved a second component solvent selected from the group consisting of a hydrocarbon solvent, a hydrochlorofluorocarbon solvent, a hydrofluorocarbon solvent, and mixtures thereof having a moisture content of less than 100 ppm. The first and second components in the deacidification composition are in a ratio of from about 30 to about 70 and from about 70 to about 30. The components, solvent and the metal alkoxides in the components are in amounts which are effective to deacidify the cellulosic material to provide preservation of a paper substrate of at least 300 years according to at least one, but preferably both, of accelerated aging tests TAPPI T-453 and TAPPI T-544, without exposing the cellulosic material or paper to high moisture/humidity levels and without creating a precipitate visible to a naked human eye on the surface of the cellulosic material being treated with the deacidification composition. The deacidification solutions described herein exhibit sufficient deacidifying properties at a relative humidity of below about 80% to deacidify the cellulosic material as described above.

In another aspect, the deacidification composition comprises at least one single metal alkoxide such as sodium alkoxide, aluminum, magnesium, zinc or at least one alkoxy metal carbonate such as magnesium methyl carbonate (MMMC), in combination with at least one double alkoxide, one double alkoxide having the formula $M_I(OR)_x$ and a second double alkoxide having the formula $M_{II}(OR)_y$ where the $M_I$ is titanium and/or zirconium and $M_{II}$ calcium and/or magnesium, and R being the same or different C1 to C4 alkyl. The double alkoxide has the formula $M_I(OR)_x$—$M_{II}(OR)_y$. The alkoxide mixture is dispersed in ultra-low moisture solvents with a moisture (water) content below 100 ppm. The low moisture solvent may include fluorocarbon, aromatic hydrocarbon or aliphatic hydrocarbon solvents treated with a molecular sieve or other desiccant to reduce the moisture content below 100 ppm, to produce ultralow moisture solvents. The single metal alkoxide comprises from about 0.03 to about 3.0 weight percent of, based upon the weight of the single metal, double metal alkoxides and solvent including alcohol, and the double alkoxide comprises from about 0.020 to about 6.0 weight percent based upon the weight of the single metal, double metal alkoxides and solvent. The single metal and double metal alkoxides are in amounts and are in ratios which are effective to deacidify the cellulosic material to provide preservation of a paper substrate of at least 300 years according to at least one, but preferably both, of accelerated aging tests TAPPI T-453 and TAPPI T-544 without exposing the cellulosic material or paper to high moisture/humidity levels and without creating a precipitate visible to a naked human eye on the surface of the cellulosic material being treated with the deacidification composition.

The preservation of paper with the use of the deacidification composition includes drying the cellulosic material to provide a dry cellulosic material; exposing the dry cellulosic material to a non-aqueous deacidification composition; and removing any non-aqueous deacidification composition which is not retained in the cellulosic material to provide a treated cellulosic material. Using the deacidification compositions according to the methods described herein cut preservation treating times at least 5, and are generally more than 10 to even more 100 times faster that than known processes under the same time and temperature conditions which only use double metal alkoxides, such as those described in U.S. Pat. No. 5,322,558 to Wittekind et al. which require large amounts of time for removal of solvent reactants and which are prone to preciptation of particulates on the surface of the paper being subjected to preservation treatment.

In another aspect, the paper treated with the deacidification composition according to the methods described herein is exposed to alkylene gas, such as ethylene, ethylene oxide, propylene oxide, and propylene to condense into the cellulose fibers of cellulosic paper without the deacidification composition, except that which is impregnated into the paper, being present. This alkylene gas treatment strengthens the treated paper by at least by 25%, and preferably 40% as measured by TAPPI Standard Method T 423 m-50 Folding Endurance of Paper following accelerated aging compared to paper not being exposed to alkylene gas.

Generally, in accordance with the present application, a deacidification composition for treating printed cellulosic materials is provided. A method of making the composition and a method of preparing components of the composition also are provided. In an important aspect, the composition comprises a metal carbonate, an ultra-dry alcohol having a moisture content of less than about 100 ppm and an ultra-dry solvent having a moisture content of less than about 100 ppm, the solvent selected from the group consisting of alcohols, aliphatic hydrocarbons, hydrochlorofluorocarbons, fluorocarbons and blends thereof, in amounts effective for treating and preserving printed cellulosic materials.

According to one form, a deacidification composition may be prepared using a variety of components. In one form, the composition includes a combination of a single metal alkoxide agent treatment and a double alkoxide agent treatment in a single composition. This combination may provide better deacidification and restoration results than either of these two proven treatments are capable of providing separately.

In one form, the deacidification treatment compositions may be made by first treating alcohol, fluorocarbon, aromatic hydrocarbon or aliphatic hydrocarbon solvents with a molecular sieve or other desiccant to reduce the moisture content below 100 ppm, to produce ultralow moisture solvents. An organic metal alkoxide is blended with the ultralow moisture alcohol solvent and carbon dioxide to form an organic metal carbonate composition. Submicron-sized magnetic impurities from the organic metal carbonate composition are removed using magnetic filtration. Then the organic metal carbonate composition is filtered through a submicron filter to produce a deacidification treatment concentrate. Finally, the deacidification treatment concentrate is blended with the ultralow moisture solvent to provide a deacidification treatment solution having relatively inert solvation characteristics toward inks and structural components of printed cellulosic materials. A similar process may be used to prepare a double metal alkoxide treatment agent which may be combined with the single metal alkoxide to form a combined treatment composition. In one form, this composition can be used in any known method of treating printed cellulosic materials.

The ultra-dry solvents, which generally are available in standard volume commercial containers, are made in a process comprising passing the solvent through one or more drying columns. The solvent then is recirculated to the container, with re-circulation of the solvent through the container and column occurring for a period effective for reducing the moisture content to less than about 100 ppm to provide an ultra-dry solvent.

In one form, filters may be used to prepare a treatment solution, such as 0.1, 0.05 micron filters and the like. Particles smaller than about 0.05 micron particle sizes are more likely to penetrate cellulose materials and fibers.

The first and second components of the solution may include particles and/or molecules that are small enough to enter the pores of most cellulose materials. In some forms, certain cellulose materials have pores of about 20 to about 160 nanometers. In some forms, the active materials in the first and second components, the single metal alkoxide and the double metal alkoxide, may have sizes in a range of about 0.5 to about 1 nanometer. In this regard, the active materials are small enough to enter the pores of the cellulose materials. Further, in some forms, the active materials have a combined solubility such that an effective amount of the active materials remains in the pores and throughout the lumens of the fibers of the cellulose materials as the solvent is removed.

DETAILED DESCRIPTION

Figure 1:
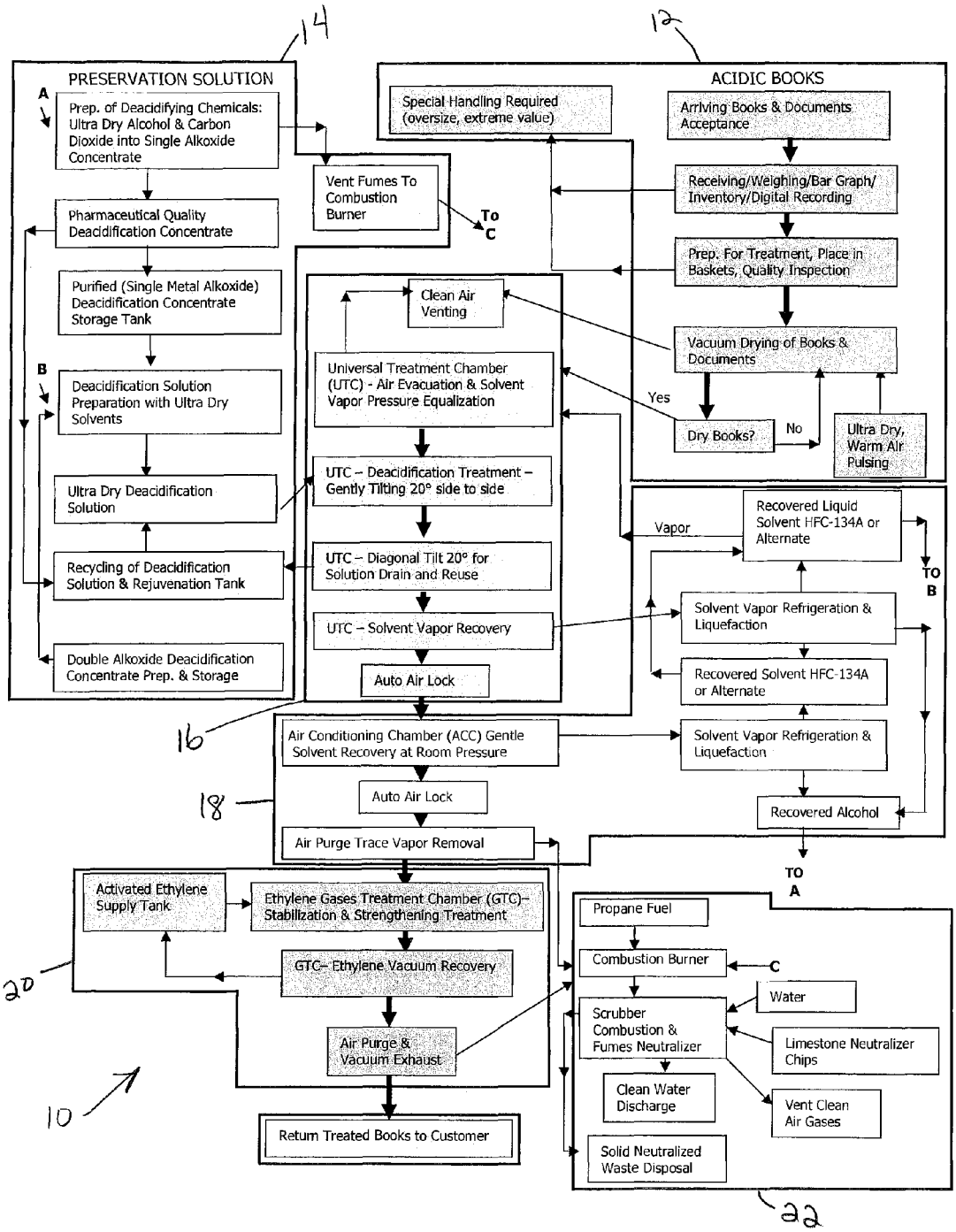
FIG. 1 is a flow diagram illustrating one method of making compositions and treating printed cellulosic materials with those compositions, including various sub-processes.

The present application is directed to a composition and method for treating printed cellulosic materials to preserve the materials with little to no negative impact on inks, images, bindings or other features. The application also is directed to methods of making the composition. More particularly, the application is directed to compositions including organic aluminum, magnesium, and/or zinc agents and ultra-dry solvents. The metal agents are blended with ultra-dry alcohol solvents with carbon dioxide to produce a non-aqueous deacidification concentrate composition. This concentrate composition is blended with other deacidification concentrates, such as double metal alkoxide materials, to produce a deacidification composition that can be used in sprays and solutions to protect books and documents against aging.

According to one form, a treatment solution may include a liquefied gas solvent-biocide-deacidification agent. In one form, such a solution may comprise aluminum, magnesium, titanium, or zinc organo-metallic alkoxides dissolved in flammable or nonflammable hydrocarbon liquefied gas solvents plus small quantities of ethanol and dissolved carbon dioxide co-solvents. Suitable flammable and nonflammable solvent choices are pentane, isohexane, and heptane or HFC-134a, and HFC-225, amongst other solvents. Solution components and solutions may be mole-sieve dried and purified through filters as fine as 0.1 or 0.05 microns to insure their nano particle active agents and solvent molecules are pharmaceutical quality and thoroughly penetrate paper substrates and fiber walls.

Deacidification solutions as described herein may be used to introduce one or more active materials into the cellulose/paper fiber while solvents can be removed, thereby leaving behind an effective amount of active materials to deacidify the cellulose. Further, solvent removal can cause some of the active materials to move about in the paper fibers, thereby helping to ensure that the active materials reach as much of the cellulose fibers as possible. Moreover, while the compositions are described as deacidifying the cellulose materials, it should be noted that at least in some cases, little to no moisture is used in the process and/or solutions. Therefore, the active materials may interact or otherwise deacidify the cellulose even without the incorporation of much, if any, moisture for deacidifying, catalyzing and/or pH adjusting purposes.

It should be noted that while the present application refers to metal alkoxides and metal carbonates, such materials may be used to create one another. For example, the metal carbonate may be combined with a solvent and carbon dioxide to create a metal carbonate. Therefore, the terms metal alkoxide and metal carbonate may refer to starting materials, intermediate materials and/or final materials that may result from one or more reactions in preparation of a deacidification composition. For example, in one form, the terms metal alkoxide carbonate may refer to one or both of a metal alkoxide and a metal carbonate.

The deacidification solution can include a variety of different metals in one or more of the single metal and/or double metal alkoxide components. For example, magnesium, zinc, aluminum, titanium, zirconium and the like, as well as mixtures thereof may be used. Further, C1-C4 carbonates could also be utilized as well as Mg and Ti ethoxide, Mg ethoxide Al isopropoxide, Zn ethoxide Al isopropoxide. In one form, zinc may be used in one or both of the single and double metal alkoxides. Zinc is known to inhibit and stop biological infestations and can assist in catalyzing condensation of petrochemical gases. Other transient metals may also be used for deacidifying, catalyzing and/or pH adjusting purposes.

Deacidification Composition

According to one form, a deacidification composition may be prepared using a variety of components. In one form, the composition includes a combination of a single metal alkoxide agent treatment composition, which may be in the form of a single metal carbonate, combined with a double alkoxide agent treatment composition in a single composition. This combination may provide better deacidification and restoration results than either of these two proven treatments are capable of providing separately. Even more importantly, the treatment benefits from blending single and double alkoxides together may: (1) give conservators the ability to develop more treatments that stop fungi and insects from attacking paper; (2) cause gases to both stabilize chemically active residues (in paper fibers that papermaking must leave); and (3) strengthen weak aged papers sufficiently for scholarly study and use.

Single Metal Alkoxide/Carbonate

In one form, a single metal alkoxide treatment composition may be prepared and used as part of a combined composition. For example, metal, an ultra-dry solvent and carbon dioxide can be combined to react and form a metal carbonate. Such metal may be in the form of metal chips, metal alkoxides and the like. The metal and solvent may be blended with stirring, shaking or other agitation as necessary to provide a blend composition.

The metal, ultra-dry solvent and carbon dioxide react to provide a deacidification agent comprising metal carbonate and/or alkoxide. In one form, magnets are immersed or otherwise contacted with the deacidification agent for removal of sub-micron particle impurities to provide a deacidification agent intermediate composition.

In one form, the organic metal carbonate and/or alkoxide concentrates may be refined and purified by removing iron and associated heavy metals (e.g., copper and cobalt) present in the black magnetic particles. The submicron particles are removed by attachment to magnets, agglomeration and filtration through membrane filters. Additionally, allowing the agglomerates to settle and decanting the concentrate may be used, as well as any combination of these procedures. Magnetic filtration may occur in single step or multiple step magnetic filtration.

The primary advantages of a single step procedure are speed of removal and minimization of the contamination from moisture. Additionally, the resulting concentrates are thinner and filter rapidly, subsequent blending, mixing, and transfer processes occur more readily, and costs of more processing and losses of concentrate composition during additional membrane filtration steps are avoided.

Single step magnetic filtration emphasizes attracting particles to the magnetic poles. Though higher concentrations are possible, typically 25.0, 37.5, 50.0, 62.5, or 75.0 percent concentrations in methanol are manufactured. Concentrations in ethanol and isopropanol are typically 25.0 to 37.5 percent by weight. Magnets are immersed in the completed concentrate to agglomerate, attract, and collect the particles.

Teflon coated rod (ALNICO V) magnets (½" by 6") designed for use as spin bars in magnetic mixers may be used. Other magnets, including electromagnets, magnetic grids, or magnetic particles which can readily be separated from the solutions being treated, and flow-through magnetic treatment chambers, may be substituted for the spin bar magnets. The magnets may be placed either in or outside of the concentrate solution being magnetically filtered.

Multiple step filtration involves repeating the complete single step cycle at two or more pre-selected concentrations. For example, the organic metal carbonate concentrate may be initially manufactured to 37.5 percent by weight concentration, magnetically filtration treated, and membrane filtered through a 0.2 micron filter. Then 25 percent more organic metal carbonate is blended with the concentrate and the now 62.5 percent concentrate is again magnetically and membrane filtered. Finally, 12.5 percent more organic metal carbonate is blended in, magnetically and membrane filtered to produce a concentration level of 75.0 percent by weight in methanol.

The primary advantages of the multi-step procedure are that stronger concentrates exceeding 100 percent by weight can be produced, and the quantities of fine black particulates do not build up because they are removed as they are formed. In addition, the potential for alcohols from multi-step concentrates to deface books and documents by dissolving inks is essentially eliminated. The quantity of free alcohol is very low, typically below 1 percent, and preferably below 0.5 percent by weight in the paper treating solutions.

Subsequent to the magnetic treatment, in one form, the composition is filtered using membrane filtration. Submicron pleated membrane (0.2 micron or smaller pore size) filtration occurs after the desired concentration is attained, typically at the 37.5 and 62.5 percent concentrations, and after the solution has been separated from the magnets bearing the black magnetic particles. The 25.0 percent by weight organic metal carbonate concentrations can be filtered through a 0.2 micron filter after overnight treatment, the 37.5 percent concentrate two days after manufacture.

The concentrates may be subjected to moderate warming during their manufacture. Additional amounts of ultra-dry solvents may be blended with the concentrates, as necessary for filtration. Filtration below the boiling point of the alcohol being used is essential. The heat reduces the viscosity of the concentrates, and improves magnetic filtration by reducing the required propelling pressure and increasing the rate of flow through membrane filters.

Membrane filters commercially available having pores larger than 0.2 microns do not completely remove the agglomerated particles and residual fines from concentrate solutions. Ultra-fine membrane filters, e.g., 0.1, 0.05, and 0.01 micron actual pore size (finest currently commercially available is 0.01 microns) may be substituted for the 0.2 micron filters to produce more pure filtrates.

Filtration provides a first component deacidification concentrate. The first component deacidification concentrate may then be blended with an ultra-dry solvent to provide a first component deacidification composition. In one form, the solvent is an alcohol with 1 to 4 carbon atoms, an aliphatic hydrocarbon with 1 to 8 carbon atoms, a fluorocarbon hydrocarbon, or mixtures thereof. The first component deacidification concentrate and solvent may be blended with stirring, shaking or other agitation as necessary to provide a blend composition.

In another embodiment, metal alkoxides, such as organic aluminum alkoxides, with or without a carbon dioxide adduct and either alone or in combination with organic magnesium or zinc agents, are also useful deacidification agents. They may be soluble directly in aliphatic and fluorocarbon solvents without an alcohol co-solvent.

In one form, the blending of powdered metal ethoxides (or metals generally) with an ultra-dry alcohol (methanol, ethanol, isopropanol or isobutanol) with carbon dioxide occurs more rapidly. The concentrates of metal carbonates in methanol/ethanol are much thinner, easier to process and filter, and more pure following filtration.

In one form, solids contents from about 25 to about 110 percent by weight of the organic metal carbonate in methanol may readily be produced, from about 25 to about 50 percent in ethanol, from about zero to about 40 percent in isopropanol and from about 0 to about 30 percent is isobutanol.

These ultra-dry, stronger concentrates of organic metal carbonates form stable solutions in non-chlorinated fluorocarbon solvents such as difluoroethane (HFC-152a) and tetrafluoroethane (HFC-134a). When first blended, the concentrates may instantaneously precipitate out of solution on contact with HFC-134a and slowly, over one to three or more days, gradually with agitation (shaking and stirring) form a stable solution. The concentrates tend to go into solution in HFC-134a very rapidly when the HFC-134a is added in increments, e.g., 1:1, 1:4, 1:8, etc.; whereas direct blending at a 1:8 ratio produces a precipitate.

Varying the temperature of the final solution over a range from about −10 to about 130° F. and its concentration from less than about 1 to about 50 percent by weight had no effect on the stability of the solution in HFC-134a solvent.

One form of a single metal alkoxide/carbonate composition for preserving paper includes from about 0.1 to about 4.0 percent of organic metal carbonate, from about 0.5 to about 10 percent by weight of ultra-dry alcohol and from about 86 to about 99 by weight aliphatic or fluorocarbon solvent, each based upon the weight of the total composition. In one aspect, from about 0.5 to about 3.0 percent metal carbonate of the deacidification composition is thoroughly impregnated throughout the paper being protected against aging.

According to one form, the first component (single metal alkoxide/carbonate) has from about 0.03 to about 4 wt. %, based upon the weight of first component, of at least one of a single metal alkoxy and/or alkoxy carbonate, such as an alkoxy magnesium carbonate, an alkoxy aluminum carbonate and an alkoxy zinc carbonate; from about 0.025 to about 10 wt. % based upon the weight of the first component of a C1-C4 alcohol having a moisture content of less than 100 ppm; and from about 86 to about 99 wt. % based upon the weight of the first component of a solvent having a moisture content of less than 100 ppm, the solvent selected from the group consisting of an aliphatic hydrocarbon, a hydrofluorocarbon, a hydrochlorofluoro carbon and mixtures thereof.

One form includes methoxy magnesium methyl carbonate (MMMC) deacidification agent (which may include ethoxy components) blended with HFC-134a at 0.5 to 4.0% by weight with a very low level, less than 1% by weight, of free methanol in the treatment composition. More methanol, up to 10 percent may be used, if desired.

Another form includes from about 0.25 to about 5.0 percent by weight of isopropoxy magnesium isopropyl carbonate (PMPC) blended with HFC-134a solvent including from about 1.0% to about 10% isopropanol. The PMPC concentrate may include methyl and/or ethyl carbonate components.

Deacidification agents, MMMC and PMPC produce similar deacidification treatment results with HFC-134a. The MMMC is preferred because stronger concentrates may be prepared, the recovered solvents are easier to recycle, the treated books have a much lower odor level immediately after treatment and hazards are reduced because less flammable material is involved.

Solutions of PMPC concentrate in aliphatic hydrocarbon solvents, are extremely stable and combinations of solvents even dry to powder in open beakers in air without precipitation. Non-clogging aerosol sprays, solutions for brushing, and dipping paper may be prepared that do not produce white deposits during treatment.

The single metal alkoxide treatment composition may also include ultra-dry solvents. The commercially available solvents that may be used in the present invention include alcohols having 1 to 4 carbon atoms and aliphatic and halogenated hydrocarbon solvents. Such solvents include methanol, ethanol, isopropanol, isobutanol, propane, butanes, pentanes, isohexanes, heptanes, difluoroethane (HFC-152a), and tetrafluoroethane (HFC-134a), HFC-32, HFE-7100, HFE-7200, and HFC-10-43MEE.

Moisture which may be present in solvents presents a major problem in preparing stable and non-defacing organic metal carbonate deacidification compositions, sprays, and solutions. Moisture, even under 50 or 100 ppm, may react with organic metal carbonates to form soluble hydrates or gels that may thicken the solution or produce precipitates. In an important aspect of the invention, the moisture level of alcohol solvents is no more than about 100 ppm and in a very important aspect, no more than about 25-50 ppm. In an important aspect of the invention, the moisture level of fluorocarbon and aliphatic solvents is no more than about 100 ppm and in a very important aspect, no more than about 5 ppm.

In an important aspect, the composition of the invention comprises fluorocarbon solvents. Preferably, the fluorocarbon solvent is HFC-134a. Mass deacidification solutions containing HFC-134a solvent have almost no detrimental effect on all printing inks tested. Higher alkaline reserves are possible, if desired, because the metal carbonates, especially MMMC concentrates, have increased solubility in HFC-134a. It is possible to achieve increased concentrate solubility using fluorocarbon solvents in the composition of the present application, as compared to chlorofluorocarbon solvents.

Previously soluble inks, such as purple mimeograph, photocopy, and fast printing, offset inks that HCFC solvents such as HCFC-22 destroyed, are unaffected by treatment with HFC-134a or HFC-152a, with the same and higher levels of alcohol.

An almost total lack of ink solubility (when HFC-134a solvent is substituted) indicates that alcohols have not caused inks to feather, offset, or run, etc., as heretofore believed. (Rather the CFC and HCFC solvents most likely caused such results.) As a result, low unit-cost universal mass deacidification treatment is possible for preservation of archive and library general collections. The pre-selecting or exclusion of collections or individual books for suitability for deacidification, e.g., ink sensitivity, physical condition, or type of paper is no longer necessary.

Solvents in the mass deacidification composition of the present invention can be completely recovered and recycled indefinitely with minimal benefaction requirements beyond adjustment for additional alcohol introduced in the make-up concentrate.

Examples of suitable single metal alkoxides and/or carbonates include, but are not limited to magnesium, zinc, aluminum, titanium, zirconium and the like, as well as mixtures thereof. Further, C1-C4 carbonates could also be utilized.

Double Metal Alkoxide

The double metal alkoxide component may include a variety of components and may be prepared in a variety of manners. For example, double alkoxides may include alkoxides of metals promoting solubility, such as group IV metals of the periodic system of elements and aluminum as well as tin, and alkoxides of metals which bind the free acids in the paper, such as alkaline earth metals or alkali metals, may be used.

These double alkoxides can be characterized by the general formula: $Me_I(OR)_x.Me_{II}(OR)_y$. In one form, $Me_I$ may include the metals titanium and zirconium while the metals magnesium and calcium may occupy $Me_{II}$. The OR groups can be formed from various alcohols. In one form, the alcohols include univalent alcohols with 1 to 5, and preferably 2 to 4 C atoms.

The recited double alkoxides can be used in a variety of solutions with a suitable solvent, such as containing about 0.2-8.0% by weight magnesium or calcium. Suitable solvents include, but are not limited to fluoro-chlorohydrocarbons, benzene hydrocarbons, siloxanes, or fluoro-hydrocarbons.

The double alkoxide (second component) of the deacidification solution comprises a solution of a double metal alkoxide and a second component solvent of a double metal alkoxide. The double metal alkoxide comprises at least about 0.20 weight percent, based upon the weight of the solution of the double metal alkoxide, preferably from about 0.20 to about 8.0 weight percent of the solution. The double metal alkoxide comprises a first and a second metal alkoxide associated with each other. In one form, the first metal alkoxide includes a first metal which promotes solubility and is selected from the group consisting of titanium and zirconium and the second metal alkoxide includes a second metal effective for binding acids in the paper. The second metal of the second metal alkoxide selected from the group consisting of magnesium and calcium. The double metal alkoxide is dissolved a second component solvent selected from the group consisting of a hydrocarbon solvent, a hydrochlorofluorocarbon solvent, and mixtures thereof having a moisture content of less than 100 ppm.

Examples of suitable double metal alkoxides include, but are not limited to Mg and Ti ethoxide, Mg ethoxide Al isopropoxide, Zn ethoxide Al isopropoxide, and the like, as well as mixtures thereof.

Combined Single Metal and Double Metal Alkoxides

In some forms, the single metal alkoxide composition alone may be slightly unstable and its alcohol co-solvent can affect sensitive inks. The double metal alkoxide solution by itself is generally stable. However, when sprayed or dipped, the double metal alkoxide solution leaves white deposits on paper surfaces and mass treatments require 2 to 3 weeks deacidification agent impregnation to complete solvent removal and product stabilization.

In some forms, a mixed solution, such as ranging from 70 to 30 parts single metal alkoxide composition and 30 to 70 parts double metal alkoxide composition, may have an intermediate stability, longer shelf life, affects extremely few inks, has short, hours long mass treatment cycles, and does not leave deposits on the surfaces of paper. For example, the overall composition may include about 0.03 to about 3 wt. % single metal alkoxide and about 0.020 to about 6.0 wt. % double metal alkoxide, based on the overall composition. Even black colored sheets of paper can be sprayed multiple times without leaving white surface deposits.

It is hypothesized that the single metal alkoxide portion of the composition forms a "tacky" (sticky) gel as its solvent component evaporates. It is further hypothesized that the fibrils or filaments of this gel filter out or entrap the double metal alkoxide particles and retain them in the treated paper's substrate. This defacement prevention capability of the single metal alkoxide is unexpected and quite extraordinary, particularly when one considers typical book and office paper sheets are only 0.004 inches thick and solvent evaporation commences even before the spray reaches the paper and is completed to the point of damp dryness in 1 or 2 minutes.

It should be noted that the single metal alkoxide component and double metal alkoxide component may each be prepared separately and then combined. In another form, the single metal alkoxide solution and double metal alkoxide solution are not prepared separately, but instead are prepared in a single composition.

Further, it should be noted that a number of different solvents are identified herein. Such solvents include hydrocarbon, hydrofluorocarbon, hydrochlorofluoro carbon, amongst others. It should be noted that where one of these solvents is identified, any of the solvents may be used, unless specifically indicated otherwise. Further, examples of other solvents include, but are not limited to, dichloropentanefluoropentane, amongst other solvents.

Processing

In one form, the deacidification compositions may be used with any known treatment process. Generally, a process for mass deacidification using the composition in a solution form includes first thoroughly drying under vacuum the materials to be treated. The materials then are contacted with the composition for a period of time effective for thoroughly wetting the materials. During contact, the composition may be impregnated under pressure into the materials. After the solution is removed from the materials, any solution remaining in the materials is vaporized for recovery and recycling to vacuum conditions. In some forms of this process, it is possible to recover at least about 93-95% of the deacidification solution, which can be re-used in the process.

Further, the present application is directed to a method, including a plurality of sub-processes and systems, which may be used separately and/or in combination to deacidify and/or otherwise preserve cellulosic materials. For example, in one form, such treatment may include: (1) vacuum drying the material to be treated to 50 mtorr; (2) immersing the material to be treated in a liquefied gas solvent-deacidification solution; (3) removing the solution and solvent to deposit agents and alkaline reserve throughout the material to be treated and fibers; (4) solvent recovery and recycling in a vacuum and/or air conditioning phases; (5) catalyzing petrochemical gas free-radical monomers into stabilizing cellulose and strengthening the material to be treated; and (6) reconditioning the deacidified, stabilized, strengthened and sterilized materials.

According to one form, when the single metal and double metal alkoxide solution is used, the deacidification process may be sped up compared to traditional deacidification processes. In this regard, traditional deacidification processes generally require long rehumidification processes, such as at high relative humidities, to complete the deacidification process after contact with the deacidicification solution. For example, many deacidification solutions require relatively high humidity to help the deacidification solution reach the innermost layers of the paper, such as via capillary action. The above described single metal and double metal alkoxide solution does not require long rehumidification processes.

Moreover, in one form, ambient humidification can be used after contacting the paper with the single metal and double metal alkoxide treatment solution. Therefore, no special high humidity processing steps are required. However, it should be noted that high humidity processing steps can be included if desired. In another form, ambient humidity conditions, such as during storage, may be sufficient to rehydrate the treated cellulose. In one form, by using the above described single metal alkoxide and double metal alkoxide, the overall processing time can be decreased by 3 times and in other cases by at least 5 times traditional deacidification processing times.

Additionally, as the combined single metal and double metal alkoxide solution is not as likely to precipitate as the double metal alkoxide solution alone, the combined solution can be used and applied in a number of manners. For example, in one form, the combined single metal alkoxide and double metal alkoxide solution can be sprayed. If the double metal alkoxide solution were sprayed alone in a standard application concentration, the solution may precipitate at the spray nozzle, thereby clogging the nozzle assemblies. The combined solution is capable of avoiding clogging spray nozzles while still applying an effective amount of the combined solution.

In one form, the process is environmentally sustainable, emits no contaminates, and deposits only stable, safe residues. Although preparation of deacidification concentrate solutions may occur in separate locations from the deacidification treatment site, the capture, recycling, and preparation of virgin quality recyclable solutions may preferably occur on the treatment site.

An overview of one form of a process, including subprocesses and systems, is shown in FIG. 1. Generally, in one form, the process consists of a dry or non-aqueous deacidification "particle" or molecule impregnation stage, followed by solvent removal and optional further post-treatment stages.

More specifically, FIG. 1 shows a process 10 which includes a cellulose material preparation stage, shown at 12, a deacidifying composition preparation stage, shown at 14, a deacidifying treatment stage, shown at 16, a solvent recovery stage, shown at 18, a stabilization stage, shown at 20, and a waste disposal stage, as shown at 22. The process 10 and each of the stages 12, 14, 16, 18, 20, 22 will be described in more detail below with reference to FIGS. 2-7.

Figure 2:
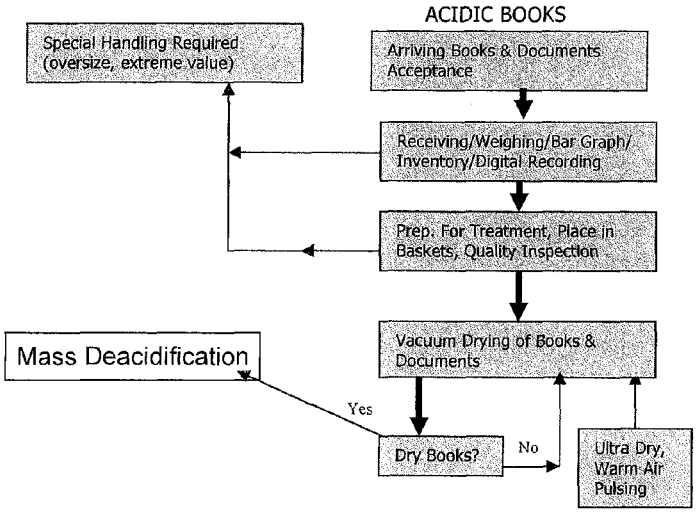
FIG. 2 is a flow diagram illustrating one method of preparing cellulosic materials for treatment.

Referring now to FIG. 2, the cellulose preparation stage is shown whereby cellulose materials, such as books, are prepared for deacidification treatment. In this regard, the cellulose materials may be placed in receptacles for inspection and for drying. As shown in FIG. 2, the cellulose materials may be dried by vacuum drying and using pulsed warm air to removed humidity from the containment vessel. In this regard, the cellulose material may start at room temperature and standard pressure. Next, the containment vessel is brought to 60° C. while lowering the vacuum to about 600-800 mtorr while pulsing replacement air. In one form, the containment vessel is maintained at 60° C. and 600-800 mtorr for 12-24 hours. If allowed to cool, the vacuum may be lowered to about 50 mtorr. In one form the process shown in FIG. 2 may result in a more complete and/or faster drying process, such as by including pulsed dry air and compressing and freezing vacuumed air and prevent moisture contamination of pump oil.

Figure 3:
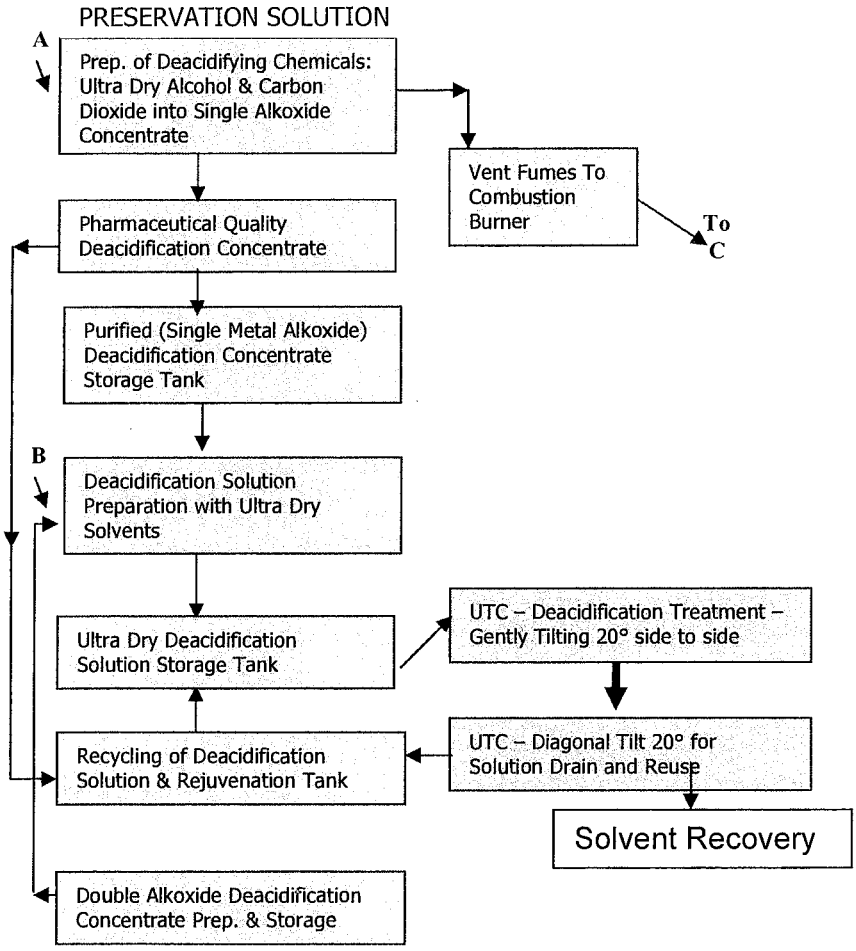
FIG. 3 is a flow diagram illustrating one method of preparing and recycling deacidifying solutions.

In one form, the process of FIG. 3 may be used to prepare deacidifying agents as described above. In one form, the single metal alkoxide and double metal alkoxide solutions may be contained in separate tanks, such as in a concentrated form, and then combined prior to and/or during application. It should be noted that the solutions prepared in FIG. 3 may also include recycled materials after being used to treat cellulose materials. In one form, the equipment used in the process of FIG. 3 may be self-cleaning.

Further, ultra-drying in accordance with the present application can be used to provide more stable deacidification products during shipment, storage, and use, as well as allows manufacture of products not possible until now. The compositions are further blended with ultra-dried solvents to produce non-aqueous deacidification compositions for use as sprays and solutions for preserving books and documents. With ultra-drying of the solvents, the quality and purity of starting solvents are established to a standard condition and can be used to produce finished products with predictable and reproducible properties.

Solvents, which are delivered in standard 55-gallon drums or similar containers, typically having moisture levels of at least about 1000 ppm, may be inexpensively transformed into ultra-dry solvents, such as described in U.S. Pat. No. 6,676,856.

Figure 4:
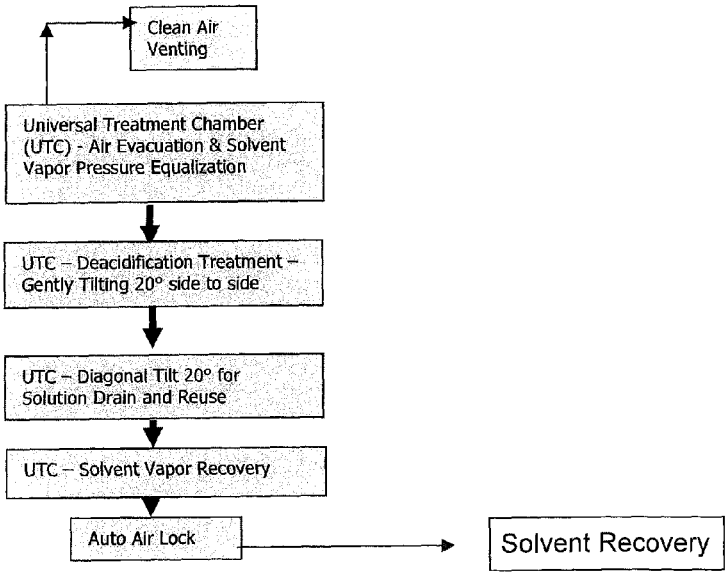
FIG. 4 is a flow diagram illustrating one method of treating cellulosic materials using a deacidifying solution.

Referring now to FIG. 4, one form of combining the single metal alkoxide and double metal alkoxide solution with the cellulose material is shown. In one form, the process of FIG. 4 may utilize an adjustable universal treatment chamber with tilting capabilities. For example, as discussed above, the cellulose materials may be prepared and placed in baskets which can then be loaded into the universal treatment chamber which can be brought to a pressure of about 2 torr. The treatment solution can be added to contact the cellulose material. In one form, the cellulose material is completely immersed in the treatment solution. Further, the universal treatment chamber or a portion thereof may tile side to side to allow bubbles to escape and otherwise assist in the treatment solution contacting all of the cellulose material.

The cellulose material can be left immersed in the treatment solution for any desired time, such as, for example, 5-10 minutes. After treatment, the solution is drained away from the cellulose material. Next, the chamber is brought under a vacuum to remove further solvent and/or unused treatment solution. According to one form, the process of FIG. 4 may result in nearly 100% recycling of recovered solvents and solutions with little to no emission of the solvents or solutions to the environment.

Figure 5:
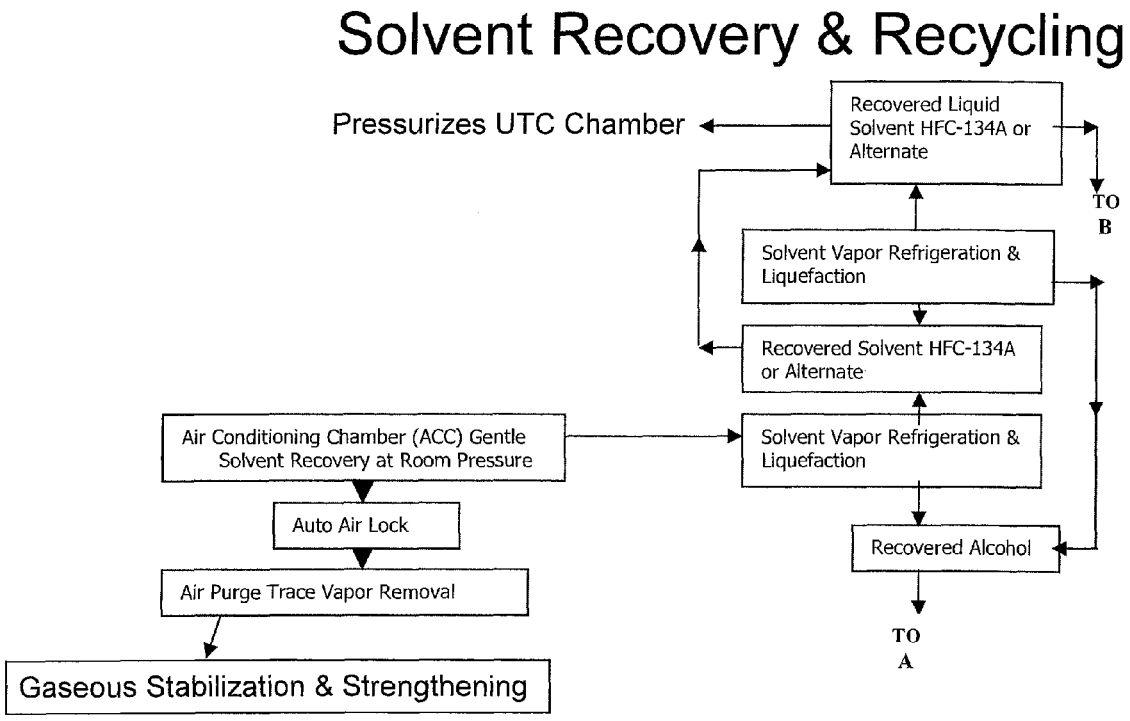
FIG. 5 is a flow diagram illustrating one method of solvent recovery and recycling.

Referring now to FIG. 5, a further post-treatment process can be used to recover additional solvent and/or unused treatment solution. The process may include air conditioning type steps to recover solvent. For example, the treated cellulose material can be loaded into a chamber which is circulates gas to remove solvent through an air conditioning system. A circulation system may be used whereby gas, such as air, is pulled from the chamber, compressed to 100-150 psig and then exposed to low temperatures, such as −20 to −30° F. This can be used to strip the solvent out as a liquid. The remaining gas can be expanded to standard pressure and then heated to 125-140° F. before returning to the chamber to recover additional solvent. In one form, the air used in this recovery stage can be very dry air and useful for drying of cellulose materials, such as in FIG. 2.

In one form, the process of FIG. 5 may result in nearly 100% recycling of recovered solvents. Further, in one form, the use of a high efficiency air conditioning chamber may permit the use of inexpensive, even domestic quality, components that can be replaced at ambient operating conditions.

In one form, the above described air conditioning treatment can be used to provide a more gentle treatment procedure, accelerate solvent recovery, and prepare the cellulose materials for stabilizing and strengthening. According to one form, books in batches of 50 to 60 books can be processed at one time, though other forms include significantly more books in a single batch. In one form, smaller batches permit tighter quality control while maintaining uniform temperatures. Smaller batches may also permit operating at warmer temperatures, minimizing the harmful buildup of alcohol in books, and continually removing and recycling alcohol and HFC-134a solvent.

Figure 6:
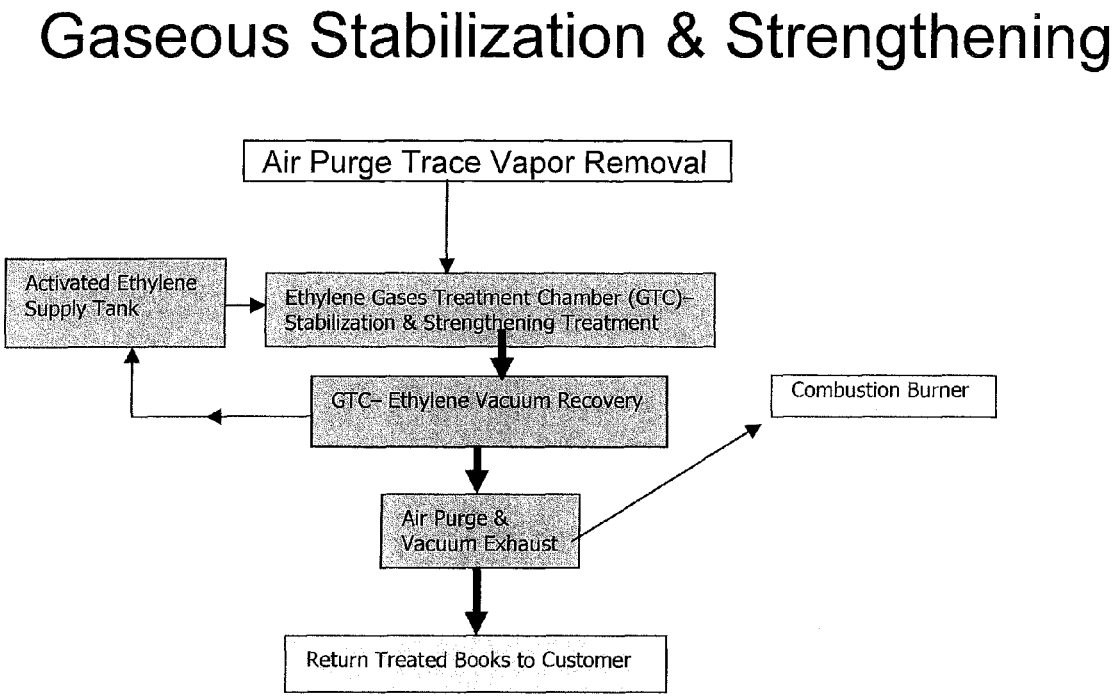
FIG. 6 is a flow diagram illustrating one method of stabilizing and strengthening cellulosic materials.

Turning now to FIG. 6, an optional further strengthening step may be included. In one form, the process of FIG. 6 may be used to deactivate residual chemically unstable groups in the cellulose materials. Further, in one form, the process of FIG. 6 may be used to catalyze the condensation of free radical petrochemical gas monomers in the cellulose to replace bonds broken during aging. For example, materials such as ethylene gas and other materials described in U.S. Pat. No. 3,676,055 can be applied to the treated and dried cellulose materials after the deacidification processing described above. Such processing can occur in a different, but similar, chamber than the initial deacidification process, such as shown in FIG. 4.

In one form, a gaseous treatment that catalyzes petrochemical gases like ethylene oxide, ethylene, propylene oxide, and propylene can be used to condense into the deteriorated cellulose of aged paper fibers. Such condensations could both stabilize the chemically active groups in paper fibers left over from pulping and aging and replace the cellulosic polymer bonds broken by acid catalyzed hydrolysis. Therefore, such a treatment can help strengthen the cellulosic material.

In another aspect, the paper treated with the deacidification composition according to the methods described herein is exposed to alkylene gas, such as ethylene, ethylene oxide, propylene oxide, and propylene to condense into the cellulose fibers of cellulosic paper without the deacidification composition, except that which is impregnated into the paper, being present. This alkylene gas treatment strengthens the treated paper by at least by 25%, and preferably 40% as measured by TAPPI Standard Method T 423 m-50 Folding Endurance of Paper following accelerated aging and compared to equivalent deacidified paper not being exposed to alkylene gas.

Figure 7:
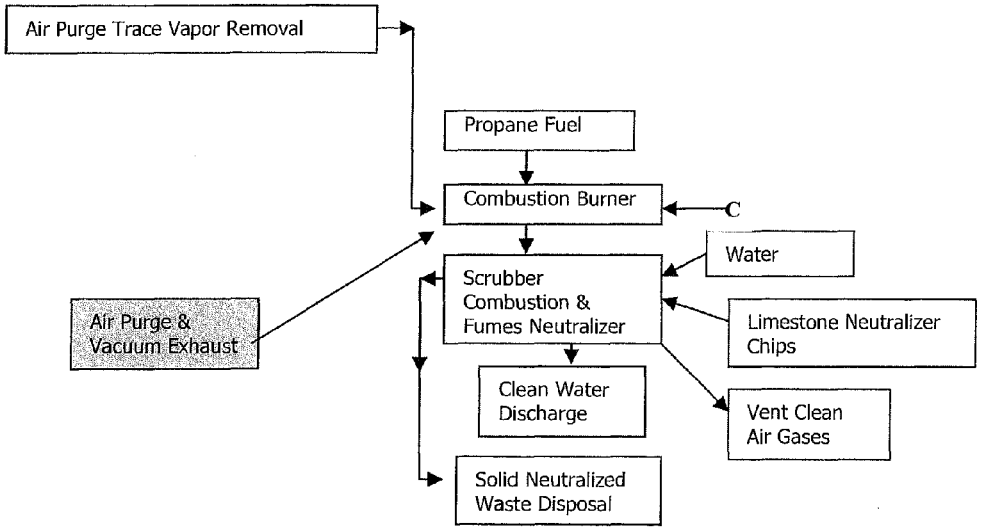
FIG. 7 is a flow diagram illustrating one method of waste disposal.

Referring now to FIG. 7, a number of environmentally responsible disposal units and processes may be employed as part of the overall process. In one form, the process of FIG. 7 may be used to destroy emission gases and residues, such as by burning. According to one form, the scrubber cleans the burned emissions by bubbling them through a tank filled with limestone chips and water. The filtered, clean water can then be used or disposed of as desired. The limestone chips and combustion filtrates can then be disposed of with normal solid waste while the remaining moisture and combustion gases are vented.

The foregoing descriptions are not intended to represent the only compositions and use of the compositions. The percentages provided herein are by weight unless stated otherwise. Changes in form and in proportion of parts, as well as the substitution of equivalents, are contemplated as circumstances may suggest or render expedient. Similarly, while exemplary compositions and methods have been described herein in conjunction with specific embodiments, many alternatives, modifications, and variations will be apparent to those skilled in the art in light of the foregoing description.

What is claimed is:

1. A deacidification composition comprising:

at least one single metal alkoxide; and at least one double metal alkoxide having two metal alkoxides associated with each other, the double metal alkoxide comprising one metal alkoxide having formula $M_I(OR)_x$ and a second metal alkoxide having the formula $M_{II}(OR)_y$ where R is the same or different C1-C4 alkyl, the single metal alkoxide and double metal alkoxide being dispersed in a low moisture solvent having a moisture content below 100 ppm, the low moisture solvent including at least one of fluorocarbon solvent, aromatic hydrocarbon solvent and aliphatic hydrocarbon, the single metal alkoxide comprising from about 0.03 to about 3.0 weight percent, based upon the weight of the single metal, double metal alkoxides and solvent, and the double alkoxide comprising from about 0.020 to about 6.0 weight percent, based upon the weight of the single metal, double metal alkoxides and solvent, the single metal and double metal alkoxides in a ratio and the single metal and double metal alkoxide and low moisture solvent in amounts which are effective to not create a precipitate which is visible to the naked eye on the surface of a cellulosic material being treated.

2. The deacidification composition of claim 1 wherein the single metal alkoxide includes magnesium, zinc, aluminum, sodium, calcium, and mixtures thereof.

3. The deacidification composition of claim 1 wherein the single metal alkoxide reacts to take the form of a carbonate.

4. The deacidification composition of claim 1 wherein the single metal alkoxide is selected from the group consisting of sodium ethoxide, aluminum n-butoxide and combinations thereof.

5. The deacidification composition of claim 1 wherein $M_I$ is titanium and/or zirconium and $M_{II}$ is calcium, zinc, aluminum, and/or magnesium.

6. The deacidification composition of claim 1 wherein the double metal alkoxide is selected from the double metal alkoxide is selected from the group consisting of Mg and Ti ethoxide, Mg ethoxide Al isopropoxide, Zn ethoxide Al isopropoxide, and mixtures thereof.

7. The deacidification composition of claim 1 wherein the moisture content of the solvent is less than about 50 ppm.

8. The deacidification composition of claim 3 wherein the moisture content of the solvent is less than about 15 ppm.

9. A deacidification composition comprising:

at least one single metal alkoxy carbonate and at least one double metal alkoxide having two alkoxides associated with each other, the double metal alkoxide comprising one alkoxide having formula $M_I(OR)_x$ and a second alkoxide having the formula $M_{II}(OR)_y$ where R is the same or different C1-C4 alkyl, the single metal alkoxy carbonate and double metal alkoxide being dispersed in a low moisture solvent having a moisture content below 100 ppm, the low moisture solvent including at least one of fluorocarbon solvent, aromatic hydrocarbon solvent and aliphatic hydrocarbon solvent, the single metal alkoxy carbonate comprising from about 0.03 to about 3.0 weight percent, based upon the weight of the single metal alkoxy carbonate, double metal alkoxide and solvent, the double metal alkoxide comprising from about 0.020 to about 6.0 weight percent, based upon the weight of the single metal alkoxy carbonate, double metal alkoxide and solvent, the single metal alkoxy carbonate and double metal alkoxide in a ratio and the single metal alkoxy carbonate and double metal alkoxide and low moisture solvent in amounts which are effective to not create a precipitate which is visible to the naked eye on the surface of the cellulosic material being treated.

10. The deacidification composition of claim 9 wherein the single metal alkoxy carbonate is selected from the group consisting of organic aluminum carbonate, organic magnesium carbonate, organic zinc carbonate and blends thereof.

11. The deacidification composition of claim 9 wherein the single metal alkoxy carbonate includes magnesium, zinc, aluminum, sodium, calcium, and mixtures thereof.

12. The deacidification composition of claim 9 wherein the single metal alkoxy carbonate is a carbonate form of a material from the group consisting of sodium ethoxide, aluminum n-butoxide and combinations thereof.

13. The deacidification composition of claim 9 wherein $M_I$ is titanium and/or zirconium and $M_{II}$ is calcium, zinc, aluminum, and/or magnesium.

14. The deacidification composition of claim 9 wherein the double metal alkoxide is selected from the group consisting of Mg and Ti ethoxide, Mg ethoxide Al isopropoxide, Zn ethoxide Al isopropoxide, and mixtures thereof.

15. The deacidification composition of claim 9 wherein the moisture content of the solvent is less than about 50 ppm.

16. The deacidification composition of claim 15 wherein the moisture content of the solvent is less than about 15 ppm.

17. The deacidification composition of claim 1 wherein the solvent comprises at least one of an alcohol and carbon dioxide.

* * * * *